US006403538B1

(12) United States Patent
Ozaki et al.

(10) Patent No.: US 6,403,538 B1
(45) Date of Patent: Jun. 11, 2002

(54) GREASE COMPOSITION FOR CONSTANT VELOCITY JOINTS

(75) Inventors: Takahiro Ozaki; Tsutomu Yoshida; Ryuichi Masumori, all of Tokyo (JP)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/936,589

(22) PCT Filed: Mar. 14, 2000

(86) PCT No.: PCT/EP00/02270

§ 371 (c)(1),
(2), (4) Date: Sep. 14, 2001

(87) PCT Pub. No.: WO00/55284

PCT Pub. Date: Sep. 21, 2000

(51) Int. Cl.[7] ..... C10M 169/06

(52) U.S. Cl. ..... 508/367; 508/362; 508/371; 508/375; 508/379; 508/552

(58) Field of Search ..... 508/243, 367, 508/552

(56) References Cited

U.S. PATENT DOCUMENTS

| | | | | |
|---|---|---|---|---|
| 4,889,647 A | | 12/1989 | Rowan et al. | |
| 5,207,936 A | * | 5/1993 | Anzai et al. | 508/552 |
| 5,412,130 A | | 5/1995 | Karol | |
| 5,589,444 A | * | 12/1996 | Hatakeyama | 508/168 |
| 5,607,906 A | * | 3/1997 | Okaniwa et al. | 508/168 |
| 5,612,298 A | | 3/1997 | Bae et al. | |
| 5,650,380 A | * | 7/1997 | Fletcher | 508/168 |
| 5,854,183 A | * | 12/1998 | Hasegawa et al. | 508/316 |
| 5,952,273 A | * | 9/1999 | Suzuki et al. | 508/168 |
| 6,037,314 A | * | 3/2000 | Kondo et al. | 508/363 |
| 6,258,760 B1 | * | 7/2001 | Ozaki et al. | 508/365 |
| 6,319,880 B1 | * | 11/2001 | Okaniwa et al. | 508/168 |
| 6,333,297 B2 | * | 12/2001 | Takabe | 508/364 |

FOREIGN PATENT DOCUMENTS

| | | | |
|---|---|---|---|
| EP | 0 633 304 A | 1/1995 | C10M/169/06 |
| WO | 94 11470 A | 5/1994 | C10M/169/06 |

* cited by examiner

*Primary Examiner*—Ellen M. McAvoy
(74) *Attorney, Agent, or Firm*—Kim Muller

(57) ABSTRACT

Grease composition for constant velocity joints comprising a base oil and urea-based thickener, which grease further comprises, (A) from 0.1 to 10% by weight of an optionally substituted molybdenum-organocyclic compound containing at least 5 ring atoms, wherein each ring atom attached directly to the molybdenum atom is a hetero atom, (B) from 0.1 to 5% by weight of at least one sulphur-containing additive chosen from the group consisting of sulphur olefins, sulphur-phosphorus extreme-pressure agents, ashless dithiocarbamates, polysulphides, thiadiazoles and zinc dithiocarbamate, and (C) from 0.1 to 5% by weight of at least one phosphorous-containing additive chosen from the group consisting of molybdenum dithiophosphate, zinc dithiophosphate and triphenylphosphorothionate; a method of lubricating a constant velocity joint comprising packing it with said grease and a constant velocity joint packed with said grease.

10 Claims, No Drawings

GREASE COMPOSITION FOR CONSTANT VELOCITY JOINTS

The present invention relates to a grease composition for constant velocity joints, a method of lubricating a constant velocity joint and to a constant velocity joint packed with a grease.

Constant velocity joints can be used in front engine/front wheel drive cars, in cars with independent. suspension, or in 4-wheel drive vehicles. The constant velocity joints are special types of universal couplings which can transmit drive from the final reduction gear to a road wheel axle at constant rotational velocity. The two major categories of constant velocity joint are plunging and fixed constant velocity joints and are usually used in a vehicle in suitable combinations.

The trends towards high output automobile engines, smaller and lighter constant velocity joints (hereinbelow abbreviated to CVJs) and larger angles of incidence has increased the demands placed upon CVJs and has resulted in a tendency for the temperature of joints to increase.

Plunging velocity joints rotate while transferring the torque and so slide resistance arises in the direction of the axis and this causes the motor vehicle to suffer vibrations, acoustic beating noises, and small rolling motions, particularly under certain driving conditions. Such noise, vibrations, and motions can be unpleasant to the vehicle occupants.

In order to overcome this problem, countermeasures concerning the working surfaces of CVJs have been investigated. Lubricating compositions commonly used in other automobile applications, such as internal combustion engines, do not provide adequate lubrication when used in CVJs. Nevertheless, certain specialised low friction greases have been shown to be effective at decreasing frictional resistance in CVJs.

It is known that extreme-pressure lithium soap greases containing molybdenum disulphide, fat and oil sulphides, sulphur olefins, lead compounds and the like may be used for the lubrication of CVJs. Recently, the use of urea greases containing added molybdenum dialkyldithiocarbamate sulphide has increased, with such greases displaying useful frictional properties.

For example, Japanese Examined Patent Publication Number H4-34590, discloses a grease composition for constant velocity joints for automobiles comprising urea grease which contains, as indispensible components, (1) molybdenum dialkyldithiocarbamate sulphide and (2) one or more sulphur-phosphorus extreme-pressure additive chosen from fat and oil sulphides, sulphur olefins, tricresyl phosphate, trialkylthiophosphate and zinc dialkyldithiophosphates.

Similar technology relating to urea grease is disclosed in the specifications of Japanese Examined Patent Publication Numbers H5-79280 and H8-23034, Japanese Unexamined Patent Application Numbers H4-178499, H4-304300, H4-328198, H6-57283, H6-57284, H6-100878, H6-184583, H9-194871, H9-324190, H10-183161, H10-273691 and H10-273692, and U.S. Pat. Nos. 4,840,740, 5,160,645 and 5,499,471. These documents are involved with a decrease in friction and wear by the addition of a molybdenum dialkyldithiocarbamate to a urea grease, and also adding other additives such as zinc dithiophosphate.

There is a continual demand for low cost high performance greases which can decrease friction, and improve the vibration properties and performance of CVJs.

However, molybdenum dialkyldithiocarbamate sulphide which may be used to decrease friction and wear is very expensive, and it is difficult to lower the cost of a grease in which this additive is used. Moreover, even if molybdenum dialkyldithiocarbamate sulphide is used, it is difficult to improve upon the performance level achieved in the above mentioned various patent specifications, and this technology is considered limited.

Thus the present invention aims to provide a novel grease composition for constant velocity joints which can very effectively decrease friction and wear and which does not comprise molybdenum dialkyldithiocarbamate sulphide, more generally does not comprise molybdenum dialkyldithiocarbamate.

To achieve this goal the present inventors prepared various grease compositions and investigated their friction and wear properties as greases for constant velocity joints according to the experimental methods stipulated in ASTM D5707, that is, using an SRV (Schwingung Reibung Und Verschleiss) experimental device, and have identified a novel grease composition for constant velocity joints that can decrease friction and wear better than conventional grease.

Accordingly, the present invention provides a grease composition for constant velocity joints comprising a base oil and urea-based thickener, which grease further comprises, (A) from 0.1 to 10% by weight of an optionally substituted molybdenum-organocyclic compound containing at least 5 ring atoms, wherein each ring atom attached directly to the molybdenum atom is a hetero atom, (B) from 0.1 to 5% by weight of at least one sulphur-containing additive chosen from the group consisting of sulphur olefins, sulphur-phosphorus extreme-pressure agents, ashless dithiocarbamates, polysulphides, thiadiazoles and zinc dithiocarbamate, and (C) from 0.1 to 5% by weight of at least one phosphorus-containing additive chosen from the group consisting of molybdenum dithiophosphate, zinc dithiophosphate and triphenylphosphorothionate.

Base oils which may be used in the greases of the present invention are essentially the same type of oil as would normally be selected for oil lubrication. The base oils may be of mineral and or synthetic origin. Base oils of mineral origin may be mineral oils, for example those produced by solvent refining or hydroprocessing. Base oils of synthetic origin may typically be mixtures of $C_{10}$–$C_{50}$ hydrocarbon polymers, for example liquid polymers of alpha-olefins. They may also be a mixture of these oils. Preferably, the base oil is of mineral origin.

Examples of mineral oils that may conveniently be used include those sold by the Royal Dutch/Shell Group of companies under the designations "HVI" or "MVIN". Polyalphaolefins and base oils of the type manufactured by the hydroisomerisation of wax, such as those sold by the Royal Dutch/Shell Group of companies under the designation "XHVI" (trade mark), may also be used.

Any urea compound can be used as the urea-based thickener. Examples include mono-, di-, tri- and tetraurea. Various thickeners which contain urea such as urea-urethane compounds and urea-imide compounds can also be used. The grease composition preferably contains 2 to 20% by weight of urea thickener, more preferably 5 to 20% by weight based on total weight of composition.

The optionally substituted molybdenum-organocyclic compound (A) of the present invention contains at least 5 ring atoms, including at least one molybdenum atom. A ring atom is an atom in a molybdenum-organocyclic ring, which ring is preferably a monocyclic ring, i.e. it does not form part of a spiro- bi- or polycyclic ring system. Each ring atom attached to a molybdenum atom is a hetero atom, preferably an oxygen, nitrogen or sulphur atom, most preferably an oxygen atom.

The optionally substituted molybdenum-organcyclic compound (A) preferably contains from 5 to 12 ring atoms, more preferably 5 to 8 ring atoms. Other than a molybdenum ring atom, the ring atoms are preferably predominantly organic in nature. Preferred ring atoms are carbon atoms and hetero atoms e.g. oxygen, nitrogen, sulphur and phosphorus atoms. Optionally substituted molybdenum- organocyclic compounds (A) suitable for use in the present invention are obtainable using reactions analogous to, and according to, those described in U.S. Pat. Nos. 4,889,647, 5,412,130 and 5,137,647.

Preferred compounds (A),are optionally substituted 1,3-heteroatom-2-molybdenum-2,2-dioxoorganocyclic compounds.

Optional substituents of the molybdenum-organocyclic compounds (A) include alkyl, alkenyl, aryl, or alkaryl groups, fatty residues containing from 1 to 50 carbon atoms, and polyolefin residues having a molecular weight of from 150 to 1200. It is preferred that such alkyl, alkenyl, aryl, or alkaryl groups are predominantly hydrocarbyl groups.

Optional fatty residue substituents of (A) may be derived from fatty oils or fatty acids. Fatty oils are glycerol esters of fatty acid. Such esters are commonly known as vegetable oils or animal oils. Particularly useful fatty residue substituents of (A) are derived from fatty oils of coconut, corn, cottonseed, linseed, peanut, soybean and sunflower seeds. It is also possible to use compounds (A) substituted by animal fatty residue such as a fatty residue of tallow oil. The fatty residues may be saturated or unsaturated. Particularly useful are residues from lauric, palmitic, stearic, oleic, linoleic, and linolenic acids. Preferred fatty residue substituents are groups of formula —$CH_2OCOR$ and —COR, wherein R is a fatty residue, preferably a fatty acid residue, preferably containing at least 8 carbon atoms, more preferably from 8 to 24 carbon atoms and most preferably from 8 to 18 carbon atoms. Preferably, fatty residue R is a predominantly hydrocarbyl group, preferably having a non-hydrocarbyl content of less than 25% by weight, more preferably less than 10% by weight, and most preferably is a hydrocarbyl group.

Optional polyolefin residue substituents of (A) may be saturated or unsaturated and may be derived from poly-alpha-olefins, preferably from polypropylene, polybutylene and/or polyisobutylene.

Preferred molybdenum-organocyclic compound (A) are compounds of general formula (1)

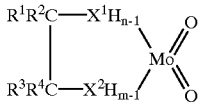

or (2)

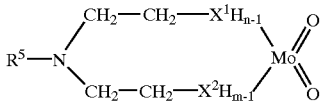

or mixtures thereof, wherein $X^1$ and $X^2$ are selected from the group consisting of oxygen, sulphur and nitrogen and where n is 1 when $X^1$ is oxygen or sulfur and n is 2 when $X^1$ is nitrogen, and m is 1 when $X^2$ is oxygen or sulfur and m is 2 when $X^2$ is nitrogen and wherein $R^1$, $R^2$, $R^3$, $R^4$ and $R^5$, each independently represents a hydrogen atom or an alkyl, alkenyl, aryl, or alkaryl group, or a fatty residue containing from 1 to 50 carbon atoms, or a residue of a polyolefin having a molecular weight of from 150 to 1200.

Preferably, $R^1$, $R^2$, $R^3$, $R^4$ and $R^5$ each independently represent a hydrogen atom or a fatty residue described earlier. $X^1$ and $X^2$ preferably represent oxygen atoms.

A particularly preferred molybdenum-organocyclic compound (A), is a compound of general formula (3)

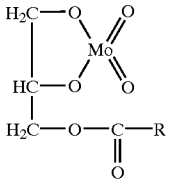

or general formula (4)

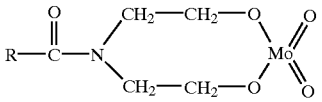

or mixtures thereof, wherein R represents a fatty residue, preferably a fatty acid residue, which residue preferably contains at least 8 carbon atoms, more preferably from 8 to 24 carbon atoms and most preferably from 8 to 18 carbon atoms. It is preferred that fatty residue R is a predominantly hydrocarbyl group, preferably having a non-hydrocarbyl content of less than 25% weight, more preferably less than 10% weight, and most preferably is a hydrocarbyl group.

A preferred optionally substituted molybdenum-organocyclic compound (A) is obtainable by reacting i) a fatty oil having 12 or more carbon atoms, ii) diethanolamine, and iii) a molybdenum source. Such a compound may be obtained using reactions according to and analogous to those described in U.S. Pat. No. 4,889,647.

The main components of a compound (A) obtainable by reacting i), ii) and iii) are believed to be compounds of general formula (3) and (4) described above.

Fatty oils suitable for use in the reaction of i), ii) and iii) include fatty oils comprising fatty acid residues having 8 to 24 carbon atoms, preferably 8 to 18 carbon atoms. Such oils are commonly known as vegetable oils or animal oils. Vegetable oils that may conveniently be used include oils derived from coconut, corn, cottonseed, linseed, peanuts, soybean and sunflower seeds. It is also possible to use animal fatty oils such as tallow oil. The molybdenum source may be an oxygen-containing molybdenum compound which can form an ester-type molybdenum complex on reaction with the product of the reaction between the fatty oil and diethanolamine. Particular examples of the molybdenum source include ammonium molybdate, molybdenum oxide and mixtures thereof.

The amount of molybdenum-organocyclic compound (A) present in the greases of the present invention is from 0.1 to 10% by weight, preferably from 0.5 to 5% by weight, more preferably 1 to 4% by weight, and most preferably 1.5 to 3.5% by weight, with respect to the total amount of urea-based grease. If there is less than 0.1% by weight, the decrease in the friction is inadequate, whereas no further improvement in effect is seen on using more than 10% by weight.

A molybdenum-organocyclic compound (A) especially suitable for use in the grease compositions of the present invention is "Molyvan 855" (Molyvan is a trade mark of the Vanderbilt Co.)

The (B) component used in the present invention is a sulphur-containing additive chosen from the group consisting of sulphur olefins, sulphur-phosphorus extreme-pressure agents, ashless dithiocarbamates, polysulphides, thiadiazoles and zinc dithiocarbamate. Whether these are used individually or as mixtures, the amount used is from 0.1 to 5% by weight, preferably from 0.5 to 2% by weight with respect to the total amount of urea-based grease. If there is less than 0.1% by weight, the decrease in the friction is inadequate, whereas no further improvement in effect is seen on using more than 5% by weight.

As sulfur-containing additive (B) it is preferred to use a sulfur-phosphorus extreme pressure additive, such as "Anglamol 99M" (Anglamol is a trademark of the Lubrizol Co.)

The (C) component used in the present invention is a phosphorus-containing additive chosen from the group consisting of molybdenum dithiophosphate, zinc dithiophosphate and triphenylphosphorothionate. Whether these are used individually or as mixtures, the amount used is from 0.1 to 5% by weight, preferably from 0.5 to 2% by weight with respect to the total amount of urea-based grease. If there is less than 0.1% by weight, the decrease in the friction is inadequate, whereas no further improvement in effect is seen on using more than 5% by weight.

Preferably the phosphorus-containing additive (C) is chosen from the group consisting of molybdenum dithiophosphate and zinc dithiophosphate.

Molybdenum or zinc dithiophosphates that may be used as component (C) are preferably selected from molybdenum or zinc dialkyl-, diaryl-, or alkaryl- dithiophosphates, in which dithiophosphates an alkyl moiety is straight chain or branched chain and preferably contains up to 12 carbon atoms.

It is also possible to include in the greases of the present invention various known additives such as antioxidants, antirust agents, extreme-pressure agents/antiwear agents, oil-improvers and thickeners in the composition of the present invention.

In accordance with the present invention there is further provided a method of lubricating a constant velocity joint comprising packing it with grease according to the present invention and there is still further provided a constant velocity joint packed with a grease according to the present invention.

The constant velocity joint may be a plunging constant velocity joint, a fixed constant velocity joint, a high speed universal joint which may include fixed or plunging types of constant velocity joint. The greases of the present invention are particularly suitable for use in a plunging constant velocity joint.

The present invention will now be described with reference to the following examples.

EXAMPLES 1–8 AND COMPARATIVE EXAMPLES 1–11

Preparation of Grease Compositions

Grease compositions according to the invention and comparative grease compositions were obtained by addition of various additives to base grease, followed by treatment with a 3-roll mill. Grease compositions according to the invention (Examples 1–8) are shown in Table 1 whilst comparative grease compositions (Comparative Examples 1–11) are shown in Table 2.

Base Greases 1–3 were prepared as follows. For each grease a purified mineral oil having a viscosity of about 11 $mm^2$/sec at 100° C. was used as a base oil.

1. Diurea Grease

1 Mol of 4,4'-diphenylmethanediisocyanate and 2 mol of octylamine were reacted in 5400 g of base oil. The resulting urea compound was homogeneously dispersed through the oil to obtain a grease product with worked penetration (25° C., 60-strokes) :301 dmm and dropping point: >270° C. The urea compound content was approximately 10 wt %.

2. Tetraurea Grease

2 Mol of 4,4'-diphenylmethanediisocyanate, 1 mol of octylamine, 1 mol of laurylamine and 1 mol of ethylenediamine were reacted in 5100 g of base oil. The resulting urea compound was homogeneously dispersed through the oil to obtain a grease product with worked penetration (25° C., 60-strokes) : 308 dmm and dropping point: 254° C. The urea compound content was approximately 15 wt %.

3. Lithium Soap Grease 150 g Of lithium 12-hydroxystearate was dissolved and dispersed uniformly in 1350 g of base oil, to obtain a grease product with worked penetration (25° C., 60-strokes): 275 dmm and dropping point: 199° C. The lithium soap content was 10 wt %.

The following compounds indicated as 1)–10) were used as additives in the grease compositions of Tables 1 and 2.

1) Molyvan 855 (Molyvan is a trade mark of the Vanderbilt Co.) as organic Molybdenum complex (Mo-Complex).
2) Anglamol 33 (Anglamol is a trade mark of the Lubrizol Co.) as sulfurized olefin.
3) Anglamol 99M (Anglamol is a trade mark of the Lubrizol Co.) as sulphur-phosphorus system.
4) Vanlube 7723 (Vanlube is a trade mark of the Vanderbilt Co.) as ashless dithiocarbamate.
5) TPS32 (trade name of a product of Elf Atochem Co., France) as polysulphide.
6) Vanlube 829 (Vanlube is a trade mark of the Vanderbilt Co.) as thiadiazol.
7) Vanlube AZ (Vanlube is a trade mark of the Vanderbilt Co.) as zinc-dithiocarbamate (Zn-DTC).
8) Sakuralube 300 (trade name of a product of Asahi Denka K.K.) as molybdenum dithiophosphate (Mo-DTP).
9) A zinc dithiophosphate (Zn-DTP) obtained from the Lubrizol Co.
10) Irgalube TPPT (Irgalube is a trade mark of the Ciba-Geigy Co.) as triphenylphosphorothionate (TPPT).

Test Conditions

The grease compositions of Tables 1 and 2 were subjected to an SRV test, in accordance with the method based on ASTM D5707, to determine their performance with respect to friction and wear.

As test items a standard ball of 10 mm diameter (material DIN 100Cr6) and a standard plate of diameter and thickness, 2.4×7.85 mm (material DIN 100Cr6) were used. During the test a load of 50 N was applied for 30 seconds, followed by a load of 200 N for 30 minutes. The frequency applied was 50 Hz and the test temperature was 50° C. The friction coefficient is the average value of friction coefficient measured over a period of 15 seconds at the end of the test period. The amount of wear is measured as the ball scar diameter at the end of the test period. Results are given in Tables 1 and 2.

TABLE 1

| | | | Example | | | | | | | |
|---|---|---|---|---|---|---|---|---|---|---|
| | | | 1 | 2 | 3 | 4 | 5 | 6 | 7 | 8 |
| Base | | 1. Diurea grease | — | 95.5 | 94.5 | 95.0 | — | — | 95.5 | 95.5 |
| grease % w | | 2. Tetraurea grease | 95.5 | — | — | — | 94.5 | 95.5 | — | — |
| Additive | A | Organic Mo-Complex[1]) | 3 | 3 | 3 | 3 | 3 | 3 | 3 | 3 |
| % w | B | Sulphurized olefin[2]) | 1 | — | — | — | — | — | — | — |
| | | Sulphur-phosphorus[3]) | — | — | 1 | 1 | 1 | 1 | — | — |
| | | Ashless dithiocarbamate[4]) | — | — | — | — | — | — | 1 | — |
| | | Polysulfide[5]) | — | 1 | — | — | — | — | — | — |
| | | Thiadiazole[6]) | — | — | — | — | — | — | — | 1 |
| | | Zn-DTC[7]) | — | — | — | 0.5 | — | — | — | — |
| | C | Mo-DTP[8]) | — | — | 1 | — | 1 | — | — | — |
| | | Zn-DTP[9]) | 0.5 | — | 0.5 | — | 0.5 | 0.5 | — | — |
| | | TPPT[10]) | — | 0.5 | — | 0.5 | — | — | 0.5 | 0.5 |
| | | Total | 100.0 | 100.0 | 100.0 | 100.0 | 100.0 | 100.0 | 100.0 | 100.0 |
| SRV test | | Friction Coefficient | 0.068 | 0.062 | 0.067 | 0.070 | 0.068 | 0.070 | 0.065 | 0.075 |
| (ASTM D5707) | | Ball scar (mm) | 0.46 | 0.44 | 0.45 | 0.48 | 0.42 | 0.45 | 0.44 | 0.42 |
| Result | | Diameter | | | | | | | | |

TABLE 2

| | | | Comparative Example | | | | | | | | | | |
|---|---|---|---|---|---|---|---|---|---|---|---|---|---|
| | | | 1 | 2 | 3 | 4 | 5 | 6 | 7 | 8 | 9 | 10 | 11 |
| Base | | 1. Diurea grease | 97 | 96 | 96 | 96 | 96 | 96 | 96 | 96 | 96 | 95 | — |
| grease % w | | 3. Lithium Soap grease | — | — | — | — | — | — | — | — | — | — | 95.5 |
| Additive | A | Organic Mo-Complex[1]) | 3 | 3 | 3 | 3 | 3 | 3 | 3 | 3 | 3 | 3 | 3 |
| % w | B | Sulphurized olefin[2]) | — | — | 1 | — | — | — | — | — | — | — | — |
| | | Sulphur-phosphorus[3]) | — | — | — | 1 | — | — | — | — | — | — | — |
| | | Ashless dithiocarbamate[4]) | — | — | — | — | 1 | — | — | — | — | — | 1 |
| | | Polysulfide[5]) | — | — | — | — | — | 1 | — | — | — | — | — |
| | | Thiadiazole[6]) | — | — | — | — | — | — | 1 | — | — | — | — |
| | | Zn-DTC[7]) | — | — | — | — | — | — | — | 1 | — | — | — |
| | C | Mo-DTP[8]) | — | — | — | — | — | — | — | — | 1 | 1 | — |
| | | Zn-DTP[9]) | — | 1 | — | — | — | — | — | — | — | 1 | — |
| | | TPPT[10]) | — | — | — | — | — | — | — | — | — | — | 0.5 |
| | | Total | 100.0 | 100.0 | 100.0 | 100.0 | 100.0 | 100.0 | 100.0 | 100.0 | 100.0 | 100.0 | 100.0 |
| SRV test | | Friction Coefficient | 0.110 | 0.110 | 0.085 | 0.091 | 0.085 | 0.097 | 0.107 | 0.084 | 0.117 | 0.110 | 0.130 |
| (ASTM D5707) | | | | | | | | | | | | | |
| Result | | Ball scar (mm) Diameter | 0.50 | 0.62 | 0.48 | 0.48 | 0.46 | 0.44 | 0.43 | 0.57 | 0.53 | 0.65 | 0.57 |

From Table 1 it can be seen that the lubricating grease compositions of Examples 1–8 have low friction coefficients and provide good resistance against wear. On the other hand, from the results in Table 2 it can be seen that urea greases lacking either component (B) and/or (C) have high friction coefficients and provide poor resistance against wear (Comparative Examples 1–10).

In Comparative Example 11, corresponding to working Example 7, a lithium soap grease was used. The friction coefficient and the resistance to wear of Comparative Example 11 was poor and if used this grease would be poorly effective in reducing friction and wear.

What is claimed is:

1. Grease composition for constant velocity joints comprising a base oil and urea-based thickener, which grease further comprises, (A) from 0.1 to 10% by weight of an optionally substituted molybdenum-organocyclic compound containing at least 5 ring atoms, wherein each ring atom attached directly to the molybdenum atom is a hetero atom, (B) from 0.1 to 5% by weight of at least one sulphur-containing additive chosen from the group consisting of sulphur olefins, sulphur-phosphorus extreme-pressure agents, ashless dithiocarbamates, polysulphides, thiadiazoles and zinc dithiocarbamate, and (C) from 0.1 to 5% by weight of at least one phosphorus-containing additive chosen from the group consisting of molybdenum dithiophosphate, zinc dithiophosphate and triphenylphosphorothionate.

2. A grease according to claim 1, wherein (A) is an optionally substituted 1,3-heteroatom-2-molybdenum-2,2-dioxoorganocyclic compound.

3. A grease according to claim 2 wherein (A) is a compound of general formula (1)

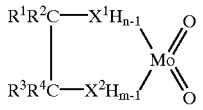

or

-continued (2)

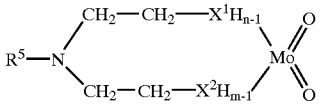

or mixtures thereof, wherein $X^1$ and $X^2$ are selected from the group consisting of oxygen, sulphur and nitrogen and where n is 1 when $X^1$ is oxygen or sulfur and n is 2 when $X^1$ is nitrogen, and m is 1 when $X^2$ is oxygen or sulphur and m is 2 when $X^2$ is nitrogen, and wherein $R^1$, $R^2$, $R^3$, $R^4$ and $R^5$, each independently represents a hydrogen atom or an alkyl, alkenyl, aryl, or alkaryl group, or a fatty residue containing from 1 to 50 carbon atoms, or a residue of a polyolefin having a molecular weight of from 150 to 1200.

4. A grease according to claim 3, wherein (A) is a compound of general formula (3)

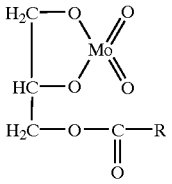

or general formula (4)

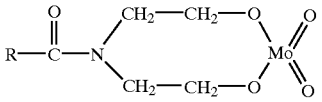

or mixtures thereof, wherein R represents a fatty residue.

5. A grease according to claim 4, wherein (A) is obtainable by reacting i) a fatty oil having 12 or more carbon atoms, ii) diethanolamine and iii) a molybdenum source.

6. A grease according to claim 1, which comprises about 1 to 4% of the molybdenum-organocyclic compound (A).

7. A grease according to claim 6, wherein the at least one sulphur-containing additive (B) is a sulfur-phosphorus extreme pressure additive.

8. A grease according to claim 7, wherein the at least one phosphorus-containing additive (C) is chosen from the group consisting of molybdenum dithiophosphate and zinc dithiophosphate.

9. A method of lubricating a constant velocity joint comprising packing it with a grease according to claim 1.

10. A constant velocity joint packed with a grease according to claim 1.

* * * * *